US007621522B2

(12) United States Patent
Yasukawa et al.

(10) Patent No.: US 7,621,522 B2
(45) Date of Patent: Nov. 24, 2009

(54) SHEET FEEDING DEVICE

(75) Inventors: Ryoichi Yasukawa, Ishikawa (JP); Kiichiro Shimosaka, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 12/019,524

(22) Filed: Jan. 24, 2008

(65) Prior Publication Data

US 2008/0203652 A1 Aug. 28, 2008

(30) Foreign Application Priority Data

Feb. 27, 2007 (JP) ..... 2007-047748

(51) Int. Cl.
*B65H 3/06* (2006.01)
*B65H 3/52* (2006.01)

(52) U.S. Cl. ..... 271/121; 271/114; 271/117

(58) Field of Classification Search ..... 271/114, 271/117, 121, 10.09, 241
See application file for complete search history.

(56) References Cited

U.S. PATENT DOCUMENTS 7,357,386 B2 * 4/2008 Shikan et al. ..... 271/10.09
7,410,161 B2 * 8/2008 Yamamoto ..... 271/124
7,422,206 B2 * 9/2008 Okuda et al. ..... 271/121
2003/0184003 A1 * 10/2003 Asada et al. ..... 271/121
2004/0061279 A1 * 4/2004 Otsuka et al. ..... 271/121
2004/0251592 A1 * 12/2004 Ruhe et al. ..... 271/109
2005/0280199 A1 * 12/2005 Steinhilber et al. ..... 271/121
2006/0097441 A1 * 5/2006 Shikan et al. ..... 271/118
2007/0007711 A1 * 1/2007 Suzuki et al. ..... 271/121

FOREIGN PATENT DOCUMENTS

JP 61-064630 A 4/1986
JP 03211123 * 9/1991
JP 2004-269231 A 9/2004
JP 2004269231 * 9/2004

* cited by examiner

*Primary Examiner*—Patrick H Mackey
*Assistant Examiner*—Patrick Cicchino
(74) *Attorney, Agent, or Firm*—Lowe Hauptman Ham & Berner

(57) ABSTRACT

A sheet feeding device includes a setting roller, a motor, a flag, a setting guide, a setting-guide swinging device, and a locking mechanism. The motor generates a driving force to rotate the setting roller. The flap swings between a standby position and a feeding position, and, when at the standby position, does not allow transport of a sheet. The setting guide swings between a standby position and a feeding position, and, when at the standby position, separates a sheet from the setting roller. The setting-guide swinging device swings the setting guide using the driving force from the motor. The locking mechanism prevents the flap from swinging to the feeding position when the flap and the setting guide are in the respective standby positions.

5 Claims, 8 Drawing Sheets

STANDBY STATE

FEEDING STATE

STANDBY STATE

FEEDING STATE

SHEET FEEDING DEVICE

RELATED APPLICATIONS

The present application is based on, and claims priority from, Japan Application Number 2007-047748, filed Feb. 27, 2007, the disclosure of which is hereby incorporated by reference herein in its entirety.

BACKGROUND OF THE INVENTION

1. Field of the Invention

The present invention relates to a sheet feeding device.

2. Description of the Related Art

Commonly-used image forming apparatuses, such as printer, includes a sheet feeding device that transports, for example, a print medium to an image reading mechanism or to an image forming mechanism. The sheet feeding device has a standby state and a feeding state. In the standby state, a plurality of print media to be read can be set in a shooter that holds the print media. In the feeding state, as a result of a pick roller and one of the print media coming into contact, only a print medium in contact with the pick roller is transported in a transport direction. When the pick roller and a print medium come into contact while the sheet feeding device is in the standby state, an edge of the print medium may become deformed. As a result, sheet-feeding performance may degrade. When the pick roller and a print medium come into contact while the sheet feeding device is in the standby state, positioning of print media in the transport direction, performed when the print media are set in the shooter, becomes unclear, resulting in inconvenience to users.

Japanese Patent Application Laid-open No. S61-064630 discloses a conventional sheet feeding device in which a pick roller and print media to be read are separated while the sheet feeding device is in standby state and the positioning in the transport direction is clarified. The sheet feeding device includes a flap-integrated setting guide. The flap-integrated setting guide includes a flap section that comes into contact with an edge of a print medium to be read to separate the print medium and a setting roller when the sheet feeding device is in feeding state. The flap-integrated setting guide prohibits the movement of the print medium in the transport direction by coming into contact with the edge of the print medium when the sheet feeding device is in standby state.

However, when the sheet feeding device transitions from standby state to feeding state, the prohibited movement of the edge of the print medium cannot be permitted before the pick roller and the print medium come into contact. This may cause deformation of the print medium transported by the pick roller immediately after transition from standby state to feeding state.

Japanese Patent Application Laid-open No. 2004-269231 discloses another conventional sheet feeding device including a flap and a setting guide are provided. The flap prohibits the movement of a print medium to be read in the transport direction by coming into contact with an edge of the print medium. The setting guide separates the print medium and the setting roller by coming into contact with the print medium. The flap and the setting guide can move using different driving sources, i.e., the flap and the setting guide can move separately. Therefore, the movement of the print medium in the transport direction, prohibited by the flap, can be permitted before the setting guide allows the pick roller and the print medium to come into contact. Thus, the deformation of a print medium, which is moved in the transport direction by the pick roller immediately after transition from standby state to feeding state, can be reduced.

However, the conventional sheet feeding device needs two drive sources to move the flap and the setting guide to allow the movement of a print medium in the transport direction, prohibited by the flap, before the setting guide allows the pick roller and the print medium to come into contact.

SUMMARY OF THE INVENTION

It is an object of the present invention to at least partially solve the problems in the conventional technology.

According to an aspect of the present invention, there is provided a sheet feeding device. The sheet feeding device includes a roller that is brought in contact with a print medium and rotates to transport the print medium, a driving unit that generates a driving force to rotate the roller, a flap that swings between a first standby position and a first feeding position, and comes into contact with an edge of the print medium at the first standby position not to allow transport of the print medium and allows the transport at the first feeding position, a guide that swings between a second standby position and a second feeding position, and comes into contact with the print medium at the second standby position to separate the print medium from the roller and allows the print medium to be in contact with the roller at the second feeding position, a guide-swinging member that swings the guide using the driving force generated by the driving unit, and a locking member that brings the flap at the first standby position into contact with the guide at the second standby position to prevent the flap from swinging to the first feeding position.

According to another aspect of the present invention, there is provided a sheet feeding device. The sheet feeding device includes a roller that is brought in contact with a print medium and rotates to transport the print medium, a driving unit that generates a driving force to rotate the roller, a flap guide that includes a flap and swings between a standby position and a feeding position, and a guide-swinging member that swings the flap guide using the driving force generated by the driving unit. The flap guide comes into contact with the print medium at the standby position to separate the print medium from the roller and allows the print medium to be in contact with the roller at the feeding position. The flap is in contact with an edge of the print medium at the standby position not to allow transport of the print medium and is not in contact with the print medium to allow the transport at the feeding position. The flap is retracted not to come into contact with the edge of the print medium that the roller starts transporting when the guide-swinging member moves the flap guide from the standby position to the feeding position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. A medium to be read is described below as a sheet of paper; however, it can be film, over-head projector (OHP) sheet, and the like. Similarly, a sheet feeding device is explained as being mounted on a an image reading device (scanner) by way of example and without limiting the scope of application of the invention.

Figure 1:
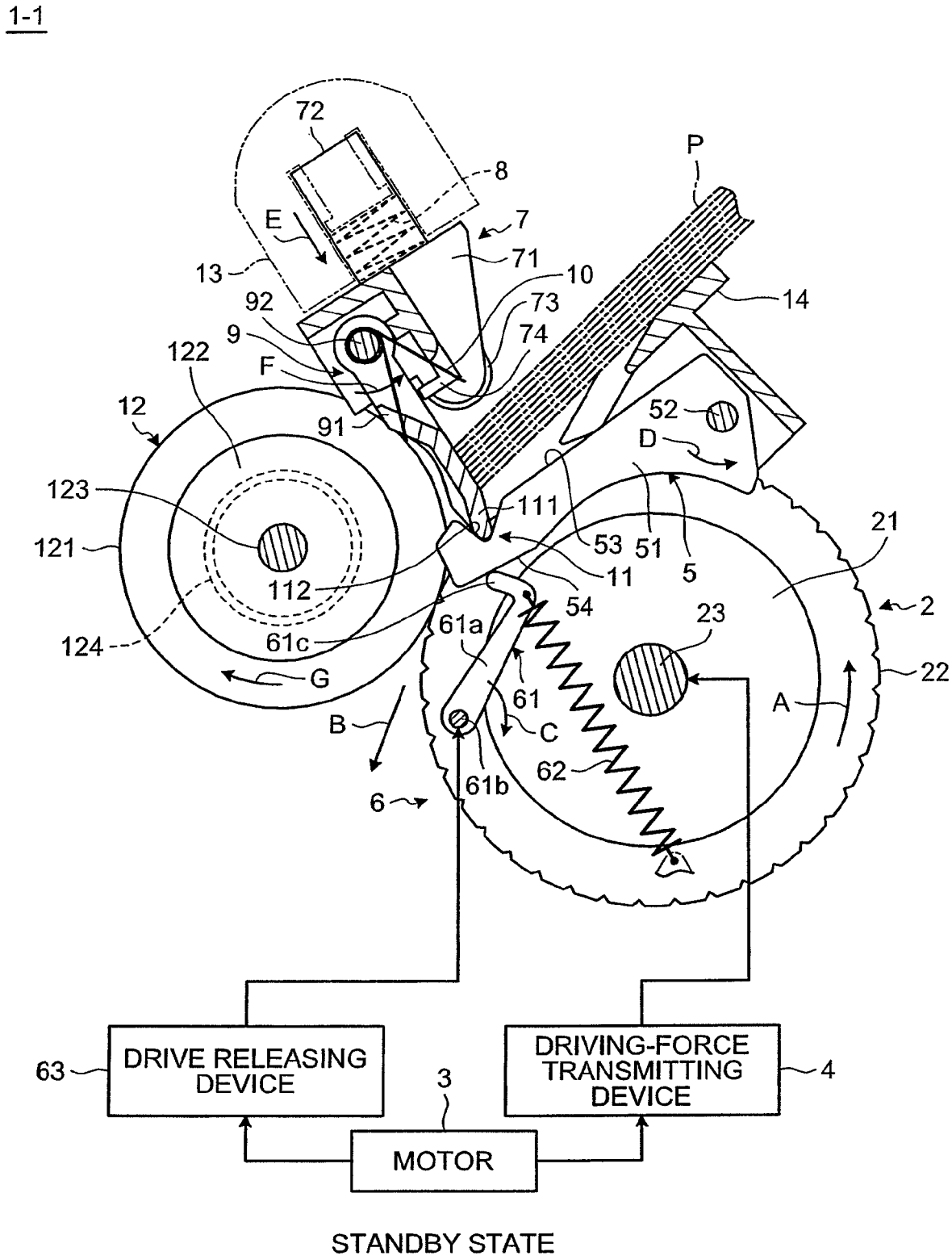
FIG. 1 is a schematic diagram of a sheet feeding device in a standby state according to a first embodiment of the present invention.
Figure 2:
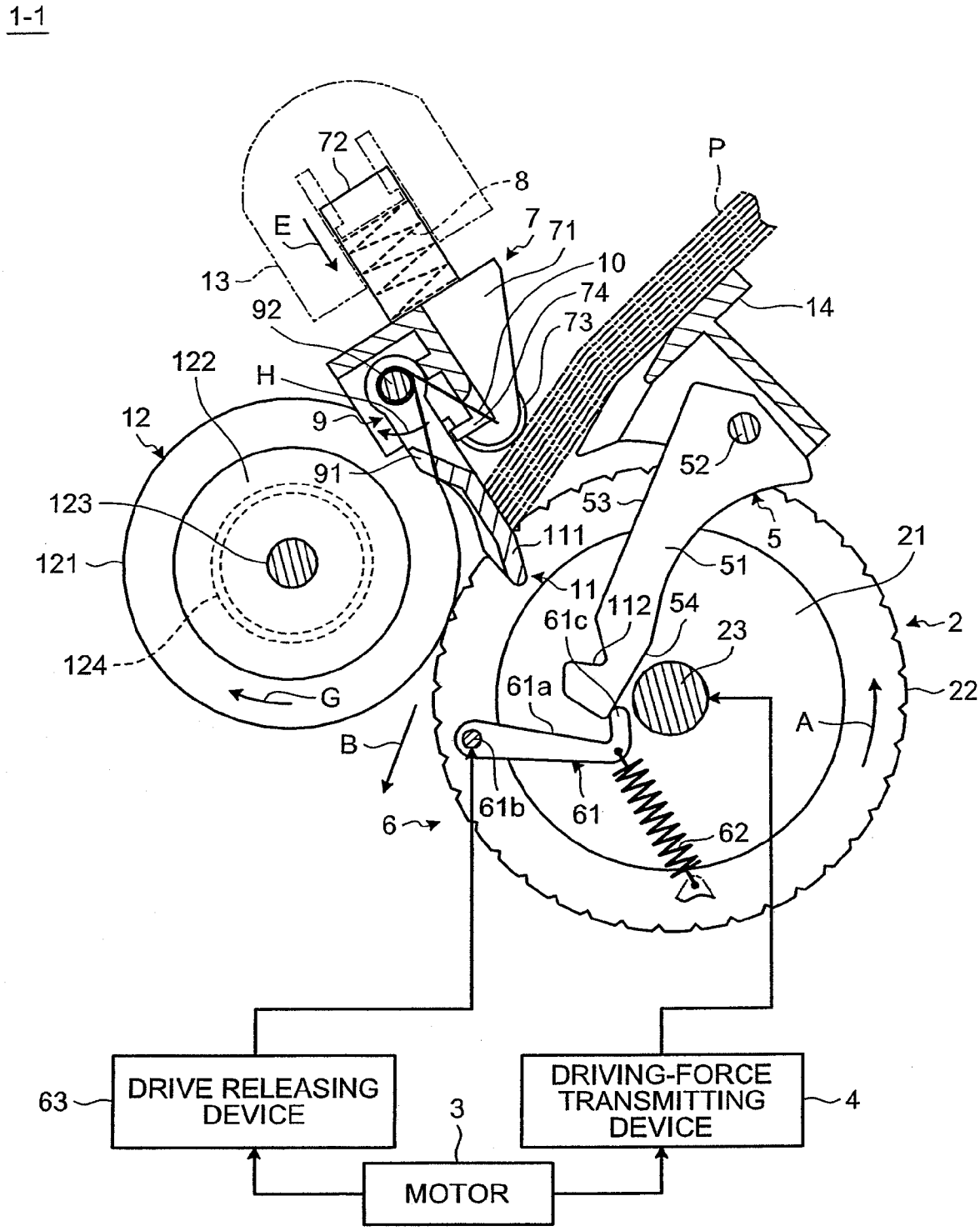
FIG. 2 is a schematic diagram for explaining the operation of the sheet feeding device shown in FIG. 1.
Figure 3:
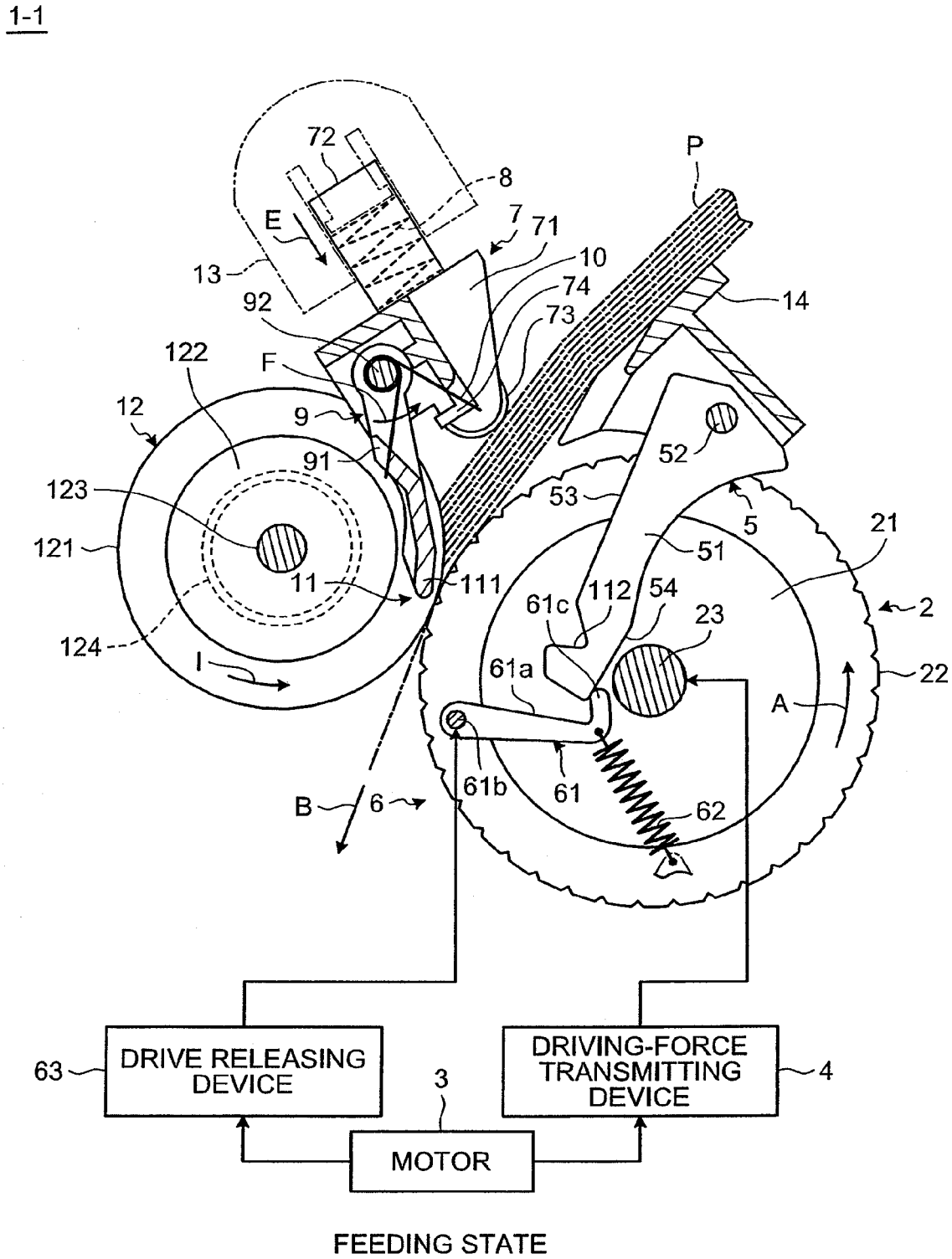
FIG. 3 is a schematic diagram the sheet feeding device shown in FIG. 1 in a feeding state.
Figure 4:
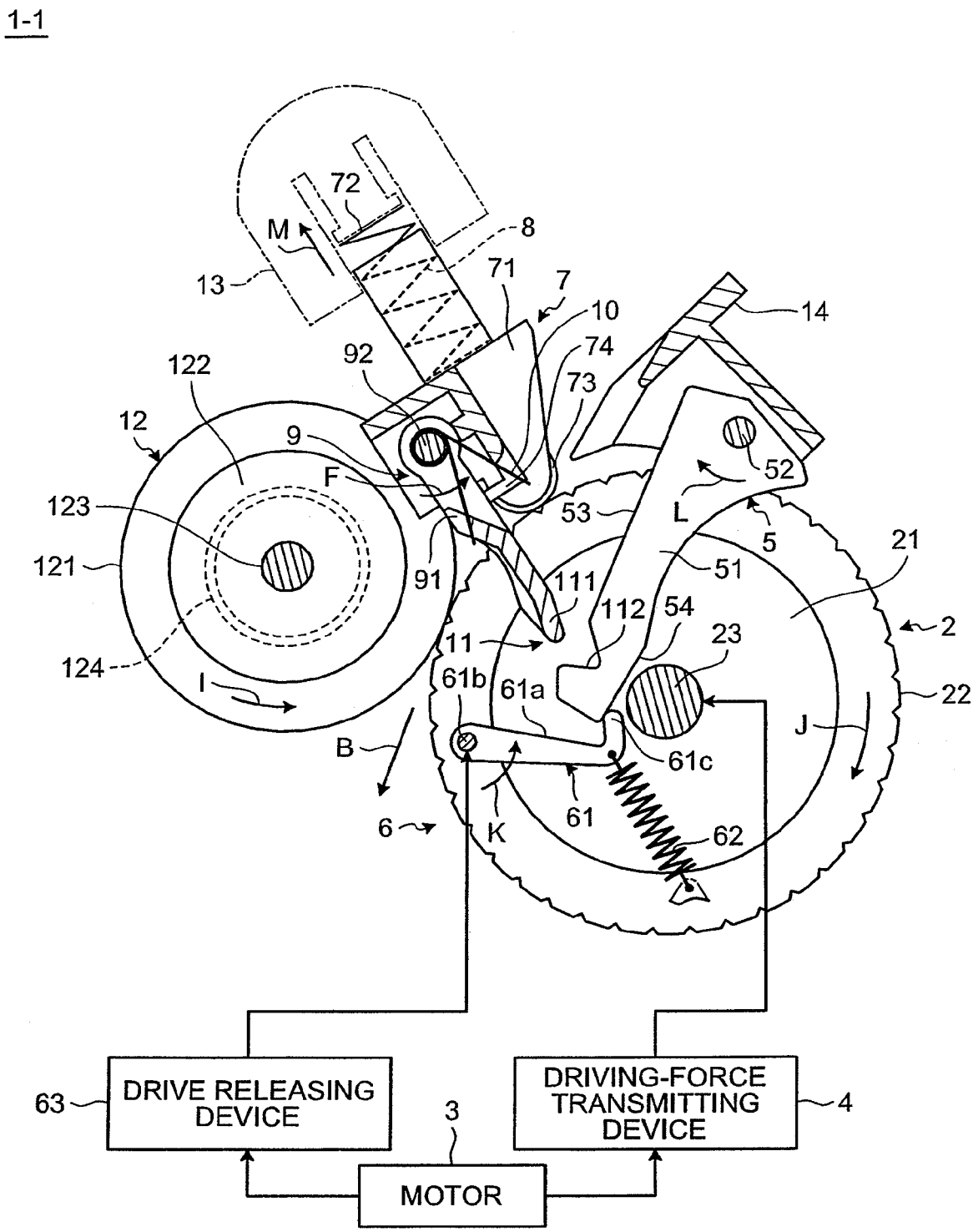
FIG. 4 is a schematic diagram for explaining the operation of the sheet feeding device shown in FIG. 1.

FIG. 1 is a schematic diagram of a sheet feeding device 1-1 (in standby state) according to a first embodiment of the present invention. FIG. 2 is a schematic diagram for explaining the operation of the sheet feeding device 1-1. FIG. 3 is a schematic diagram of the sheet feeding device 1-1 in a feeding state. FIG. 4 is a schematic diagram for explaining the operation of the sheet feeding device 1-1. The sheet feeding device 1-1 includes a setting roller 2, a motor 3, a driving-force transmitting device 4, a setting guide 5, a setting-guide swinging device 6, a pick arm 7, an arm spring 8, a flap 9, a flap spring 10, a locking mechanism 11, and a separating roller 12. A cover 13 is swingably supported with respect to a main body of the scanner (not shown). In a shooter 14 is set a plurality of sheets P.

The setting roller 2 includes a disc-shaped rotating body 21, a contacting member 22, and a rotation axis 23. The disc-shaped rotating body 21 is fixed to the rotation axis 23 and rotates integrally with the rotation axis 23. The contacting member 22 is provided on an outer peripheral surface of the rotating body 21. The contacting member 22 comes into contact with a sheet P set in the shooter 14. The contacting member 22 is made from a material, such as rubber, having a large frictional force against the sheet P. The rotation axis 23 is rotatably supported by the main body of the scanner (not shown). The rotation axis 23 is connected to the motor 3, via the driving-force transmitting device 4. The setting roller 2 rotates in a positive direction A while in contact with the sheet P set in the shooter 14. As a result, the setting roller 2 transports the sheet P in contact with the setting roller 2 in a transport direction B. A driving force generated by the motor 3 is transmitted to the rotation axis 23, via the driving-force transmitting device 4, and the setting roller 2 is driven.

The motor 3 generates the driving force that rotates the setting roller 2. The motor 3 is stored in the main body of the scanner (not shown). As shown in FIG. 1, the motor 3 transmits the driving force to the setting roller 2 via the driving-force transmitting device 4, and transmits the driving force to the setting-guide swinging device 6. The motor 3 is connected to a controlling device (not shown). The controlling device performs drive control. Here, the controlling device basically controls a driven state, a non-driven state, and a rotation direction (forward direction and reverse direction) of the motor 3.

The driving-force transmitting device 4 transmits the driving force generated by the motor 3 to the setting roller 2. The driving-force transmitting device 4 includes, for example, a gear mechanism. As shown in FIG. 1, the driving-force transmitting device 4 rotates the setting roller 2 in the positive direction A when the motor 3 rotates in a forward direction. The driving-force transmitting device 4 rotates the setting roller 2 in a negative direction J (see FIG. 4) that is an opposite direction of the positive direction A when the motor 3 rotating in a reverse direction.

The setting guide 5 adjusts a contact state between the sheet P and the setting roller 2. As shown in FIG. 1, the setting guide 5 includes a main body 51 and a rotation axis 52. A contact surface 53 and a back surface 54 opposing the contact surface 53 are formed on the main body 51. A sheet P on the setting roller 2 side among the sheets P set in the shooter 14, namely the bottommost sheet P, comes into contact with the contact surface 53. As a result, the main body 51 separates the bottommost sheet P and the setting roller 2. The rotation axis 52 is formed on one end of the main body 51. The rotation axis 52 is rotatably supported with respect to the main body of the scanner (not shown), i.e., the shooter 14. In other words, the setting guide 5 is rotatably supported with respect to the shooter 14.

The setting-guide swinging device 6 swings the setting guide 5 using the driving force generated by the motor 3. The setting-guide swinging device 6 includes a swinging arm 61, a setting guide spring 62, and a drive releasing device 63. The swinging arm 61 includes a main body 61*a* and a rotation axis 61*b*. A projection 61*c* is formed on one end of the main body 61*a*. The rotation axis 61*b* is formed on another end of the main body 61*a*. The projection 61*c* comes into contact with the back surface 54 of the main body 51 of the setting guide 5. As a result of the swinging arm 61 swinging around the rotation axis 61*b*, the setting guide 5 swings around the rotation axis 52. The rotation axis 61*b* is rotatably supported with respect to the main body of the scanner (not shown). In other words, the swinging arm 61 is rotatably supported with respect to the main body.

The setting guide spring 62 biases the setting guide 5 in a direction swinging to a feeding position, namely a feeding position direction D. The setting guide spring 62 is disposed between the swinging arm 61 and the main body of the scanner (not shown). The setting guide spring 62 applies biasing force to the swinging arm 61 to swing the swinging arm 61 in one direction C. In other words, the setting guide spring 62 can swing the setting guide 5 in contact with the swinging arm 61 in the feeding position direction D.

The drive releasing device 63 is a swinging and releasing mechanism. The drive releasing device 63 forms and releases a connection between the motor 3 and the swinging arm 61. When the motor 3 is driven to rotate in the forward direction by the control device (not shown), the drive releasing device 63 releases the connection between the motor 3 and the swinging arm 61. The driving force generated by the motor 3 is not transmitted to the swinging arm 61. Therefore, the swinging arm 61 swings in the one direction C by the biasing force from the setting guide spring 62. At this time, the setting guide 5 in contact with the swinging arm 61 swings in the feeding position direction D with the swinging of the swinging arm 61 in the one direction C. The setting guide spring 62 swings the swinging arm 61 to the feeding position using the biasing force (see FIG. 3). At this time, the setting guide 5 in contact with the swinging arm 61 is in the feeding position at which the bottommost sheet P among the sheets P and the setting roller 2 come into contact. Here, the forward direction refers to a direction in which the motor 3 is driven when the setting roller 2 is rotated in the positive direction A and the sheet P in contact with the rotating setting roller 2 is transported in the transport direction B.

At the same time, when the motor 3 is driven to rotate in the reverse direction opposite to the forward direction by the controlling device (not shown), the drive releasing device 63 connects the motor 3 and the swinging arm 61. The drive releasing device 63 swings the swinging arm 61 in another direction K (see FIG. 4) opposite to the one direction C, using the driving force generated by the motor 3. At this time, the setting guide 5 in contact with the swinging arm 61 swings in a standby position direction L opposite to the feeding position direction D, with the swinging of the swinging arm 61 in the other direction K. As shown in FIG. 1, the drive releasing device 63 swings the swinging arm 61 to a standby position using the driving force generated by the motor 3. At this time, the setting guide 5 in contact with the swinging arm 61 is positioned at a standby position in which the bottommost sheet P among the sheets P and the setting roller 2 are separated as shown in FIG. 1. In other words, as a result of the motor 3 being driven to rotate in the reverse direction, the swinging arm 61 swings the setting guide 5 from the feeding position to the standby position. Therefore, the setting-guide swinging device 6 swings the setting guide 5 between the standby position and the feeding position. In the standby position, the bottommost sheet P and the setting roller 2 are separated by the setting guide 5 contacting the bottommost sheet P. In the feeding position, the bottommost sheet P and the setting roller 2 come into contact. Here, the reverse direction refers to a direction in which the setting roller 2 rotates in the negative direction J.

The pick arm 7 comes into contact with the sheets P set in the shooter 14 by moving to the setting roller 2 side. When the setting roller 2 and the bottommost sheet P among the sheets P come into contact, the pick arm 7 presses the bottommost sheet P to the setting roller 2. The pick arm 7 includes a main body 71, a spring storing section 72, a pressing roller 73, and a stopper 74.

The main body 71 is disposed opposite to the setting roller 2 with the sheets P therebetween, when the sheets P are set in the shooter 14. The main body 71 rotatably supports the pressing roller 73 at a portion opposite to the setting roller 2. In other words, when the pick arm 7 comes into contact with the sheets P, the pressing roller 73 comes into contact with the sheets P.

The spring storing section 72 is provided in the main body 71 on a side opposite to the setting roller 2. The spring storing section 72 is cylindrical and has a bottom. The arm spring 8 is disposed within the spring storing section 72. The spring storing section 72 is rotatably supported with respect to the cover 13 in the direction in which the setting guide 5 moves, i.e., a pressing direction D. Therefore, the pick arm 7 is rotatably supported with respect to the cover 13 in the pressing direction E.

The stopper 74 restricts swinging of the flap 9 in a direction opposite to the transport direction B. The flap 9 is rotatably supported with respect to the main body 71.

The arm spring 8 biases the pick arm 7 in a direction towards the setting roller 2 side, namely the pressing direction E. The arm spring 8 is disposed between the spring storing section 72 of the pick arm 7 and the cover 13. The arm spring 8 applies a biasing force to the pick arm 7 to swings the pick arm 7 in the pressing direction E. In other words, the arm spring 8 can move the pick arm 7 in the pressing direction E when the movement of the pick arm 7 in the pressing direction E is not restricted.

The flap 9 prohibits the movement of the sheets P in the transport direction B by coming into contact with edges of the sheets P. The flap P includes a main body 91 and a rotation axis 92. The main body 91 prohibits the movement of the sheets P, set in the shooter 14, in the transport direction B by coming into contact with the edges of the sheets P. The rotation axis 92 is formed on one end of the main body 91. The rotation axis 92 is rotatably supported with respect to the main body 71 of the pick arm 7. In other words, the flap 9 is rotatably supported with respect to the pick arm 7.

The flap spring 10 biases the flap 9 in a direction in which the flap 9 swings into a standby position, namely a standby position direction F. As shown in FIG. 1, the flap spring 10 is disposed between the flap 9 and the main body 71 of the pick arm 7. The flap spring 10 applies the biasing force to the flap 9 to swing the flap 9 in the standby position direction F. Here, the stopper 74 restricts the swinging of the flap 9 in the direction opposite to the transport direction B. Therefore, the flap 9 can swing to a position at which the flap 9 comes into contact with the stopper 74, using the biasing force from the flap spring 10. In other words, the flap 9 can swing to the standby position at which the movement of the sheets P set in the shooter 14 is prohibited by the flap 9 coming into contact with the edges of the sheets P. In other words, the flap 9 can swing in a feeding position direction H (see FIG. 2) opposite to the standby position direction F, from the standby position. Therefore, when the flap 9 swings from the standby position to the feeding position, the flap 9 moves in the transport direction B of the sheet P. Here, the flap spring 10 is set such that the biasing force applied to the flap 9 is smaller than a transport force in the transport direction B applied to the sheet P by the setting roller 2 rotating in the positive direction A. In other words, because the transport force applied to the sheet P is larger than the biasing force applied to the flap 9, even when the edge of the sheet P collides with the flap 9 when the flap 9 is permitted to swing to the feeding position by the locking mechanism 11 and the sheet P is transported in the transport direction B by the setting roller 2 rotating in the positive direction A, the sheet P can push away the flap 9 and be transported in the transport direction B. Therefore, the transported sheet P swings the flap 9 to the feeding position permitting the transport of the sheet P in the transport direction B.

When the flap 9 and the setting guide 5 are at the standby positions, the locking mechanism 11 prevents the flap 9 from swinging to the feeding position, by the flap 9 coming into contact with the setting guide 5. The locking mechanism 11 includes a locking projection 111 and a locking recess 112. The locking projection 11 is formed on a tip of the flap 9 on another end of the flap 9 (an end opposite to the end on which the rotation axis 92 is formed). The locking recess 112 is formed on the contact surface 53 of the setting guide 5 that faces the flap 9 and recesses toward the back surface 54 side. The locking recess 112 is formed such as to face the locking projection 111 when the flap 9 is positioned in the standby position and the setting guide 5 is positioned in the standby position. The locking projection 111 is formed such as to enter the locking recess 112 when the flap 9 is positioned in the standby position and the setting guide 5 is positioned in the standby position. In other words, when the flap 9 and the setting guide 5 are in the standby positions, the locking projection 11 enters the locking recess 112, prohibiting the movement of the flap 9 to the feeding position. Therefore, when the sheet feeding device 1-1 is in the standby state, the flap 9 is prohibited from swinging from the standby position to the feeding position. The flap 9 can be prevented from moving against the setting guide 5 with certainty. As a result, when a user sets the sheets P in the shooter 14 while the sheet feeding device 1-1 is in the standby state, the positioning in a setting direction (substantially the same as the transport direction B) can be easily performed.

At the same time, the locking projection 11 detached from the locking recess 112 before the bottommost sheet P in contact with the setting guide 5 comes into contact with the setting roller 2 when the setting guide 5 swings from the standby position to the feeding position. In other words, the locking mechanism 11 permits the flap 9 to swing to the feeding position before the bottommost sheet P in contact with the setting guide 5 comes into contact with the setting roller 2.

Next, the separating roller 12 restricts the transport in the transport direction B of the sheets P other than the sheet P in contact with the setting roller 2. The separating roller 12 includes a rotating body 121, a torque limiter 122, a rotation axis 123, and a reverse rotation spring 124. The disc-shaped rotating body 121 is formed from a material, such as rubber, having a large frictional force against the sheet P. The rotating body 121 is fixed to the rotation axis 123 and rotates integrally with the rotation axis 123. The rotation axis 123 is rotatably supported with respect to the cover 13 of the scanner (not shown). Therefore, the separating roller 12 is rotatably supported by the cover 13. When the cover 13 is closed, or in other words, when the scanner is in a drivable state, the separating roller 12 is rotatably supported with respect to the cover 13, such that an outer peripheral surface of the separating roller 12 comes into contact with an outer peripheral surface of the setting roller 2.

When the reverse rotation spring 124 twists and becomes charged with force, the torque limiter 122 limits an amount of force with which the reverse rotation spring 124 is charged such that the reverse rotation spring 124 cannot be charged with force exceeding a certain amount. The torque limiter 122 is disposed on a same axis as the rotating body 121.

The reverse rotation spring 124 is disposed on the same axis as the rotating body 121 and the torque limiter 122. The reverse rotation spring 124 is, for example, a coil spring. Both ends of the reverse rotation spring 124 are respectively connected to a stopper (not shown). One end of the reverse rotation spring 124 is connected to the rotating body 121 via the stopper. Another end of the reverse rotation spring 124 is connected to the torque limiter 122 via the stopper. When the rotating body 121 rotates in a charging direction G, the stopper is relatively rotated. The reverse rotation spring 124 twists between the rotating body 121 and becomes charged with force. Therefore, when the reverse rotation spring 124 is charged with force, the force is applied to the rotating body 121. A rotary force in a separating direction I opposite to the charging direction G is generated. Here, the rotating body 121 comes into contact with the setting roller 2 if the sheet P is not between the rotating body 121 and the setting roller 2. Therefore, the rotating body 121 can rotate in the charging direction G, when the setting roller 2 rotates in the positive direction A using the driving force generated by the motor 3. In other words, the reverse rotation spring 124 can be charged with force when the motor 3 generates the driving force in the forward direction and the setting roller 2 rotates in the positive direction A using the generated driving force via the driving-force transmitting device 4. The reverse rotation spring 124 is connected to the stopper in a pre-charged state such that the rotary force in the separating direction I can be generated in the rotating body 121, even when the stoppers are not relatively rotated, or in other words, even in an initial state in which the reverse rotation spring 124 is not charged with force by the rotation of the rotating body 121 in the charging direction G. As a result, the reverse rotation spring 124 can generate a predetermined amount of rotary force in the separating direction I from the initial state in which the reverse rotation spring 124 is charged with force. The reverse rotation spring 124 preferably includes a spring having a small spring constant to reduce fluctuation in the rotary force in the separating direction I generated in the rotating body 121.

When the sheet feeding device 1-1 is in the standby state, the sheets P can be set in the shooter 14 that holds the sheets P. In the feeding state, only the sheet P in contact with the setting roller 2 is transported in the transporting direction B by the setting roller 2 and the bottommost sheet P, among the sheets P set in the shooter 14, coming into contact. The sheet feeding device 1-1 basically transitions from the standby state to the feeding state and transitions from the feeding state to the standby state.

When the sheet feeding device 1-1 is in the standby state, as shown in FIG. 1, the setting-guide swinging device 6 positions the setting guide 5 at the standby position. The flap 9 is positioned at the standby position. At this time, the locking projection 111 of the flap 9 enters the locking recess 112 of the setting guide 5. The locking mechanism 11 prohibits the flap 9 from swinging to the feeding position. When the setting guide 5 is positioned at the standby position, the pick arm 7 is pushed upwards in a release direction M (see FIG. 4) opposite to the pressing direction E, via the flap 9 that is prevented from swinging to the feeding position by the locking mechanism 11. As a result, a distance between the pick arm 7 and the setting guide 5, namely a distance between the pressing roller 73 and the contact surface 53 of the setting guide 5, widens. The user sets the sheets P in the shooter 14 when the sheet feeding device 1-1 is in the standby state. The edges of the sheets P set in the shooter 14 come into contact with the flap 9. Here, when the sheet feeding device 1-1 is in the standby state, the locking mechanism 11 prohibits the flap 9 from swinging to the feeding position. Therefore, when the edges of the sheets P set in the shooter 14 come into contact with the flap 9, the movement of the sheets P in the setting direction is restricted. As a result, when the user sets the sheets P in the shooter 14, positioning of the sheets P in the setting direction (substantially the same as the transport direction B) can be facilitated. The bottommost sheet P among the sheets P set in the shooter 14 comes into contact with the setting guide 5. In other words, when the sheet feeding device 1-1 is in the standby state, the setting roller 2 and the sheet P are separated. Therefore, when the sheet feeding device 1-1 is in the standby state, the bottommost sheet P is not transported in the transporting direction B by the setting roller 2, even when the setting roller 2 rotates in the positive direction A. As a result, the sheet feeding device 1-1 can realize the standby state in which the sheets P can be set in the shooter 14 that holds the sheets P.

Described below is an operation performed when the sheet feeding device 1-1 transitions from the standby state to the feeding state. First, when the controlling device (not shown) judges, for example, that an instruction to read out the sheet P is given by the scanner (not shown), the controlling device drives the motor 3 in the forward direction. When the motor 3 generates the driving force in the forward direction, the setting roller 2 rotates in the positive direction A, via the driving-force transmitting device 4. At this time, the separating roller 12 is in contact with the setting roller 2. Therefore, the separating roller 12 rotates in the charging direction G, and the reverse rotation spring 124 is charged with force. When the motor 3 generates the driving force in the forward direction, the drive releasing device 63 releases the connection between the motor 3 and the swinging arm 61. The drive releasing device 63 prevents the driving force generated by the motor 3 from being transmitted to the swinging arm 61. The swinging arm 61 swings in one direction C using the biasing force from the setting guide spring 62. The setting guide 5 swings in the feeding position direction D with the swinging of the swinging arm 61 in the one direction C. When the setting guide 5 swings in the feeding position direction D, as shown in FIG. 2, the locking projection 111 detaches from the locking recess 112. The flap 9 that is prevented from swinging to the feeding position by the locking mechanism 11 is permitted to swing to the feeding position. In other words, the flap 9 is permitted to swing in the feeding position direction H. When the setting guide 5 swings further in the feeding position direction D, as shown in FIG. 2, the flap 9 and the pick arm 7 move in the pressing direction E. The pick arm 7 presses the sheets P set in the shooter 14 in the pressing direction E. In other words, the pick arm 7 presses the sheets P to the setting roller 2 side. When the setting guide 5 swings further in the feeding position direction D, the bottommost sheet P in contact with the setting guide 5 comes into contact with the setting roller 2, as a result of the pick arm 7 pressing the sheets P in the pressing direction E. When the locking mechanism 11 permits the flap 9 to swing to the feeding position, the swinging arm 61 swings to the feeding position and the setting guide 5 in contact with the swinging arm 61 swings to the feeding position.

At this time, the setting roller 2 rotates in the positive direction A using the driving force generated by the motor 3. Therefore, the transport in the transport direction B of the bottommost sheet P among the sheets P set in the shooter 14 starts. The locking mechanism 11 permits the flap 9 to swing to the feeding position. Therefore, the bottommost sheet P of which the transport in the transport direction B by the setting roller 2 has started can move the flap 9 in the transport direction B of the sheet P without becoming deformed, even when the edge of the sheet P collides with the flap 9, because the biasing force applied to the flap 9 by the flap spring 10 is smaller than the transporting force in the transport direction B applied to the sheet P. In other words, as shown in FIG. 3, the bottommost sheet P transported in the transport direction B by the setting roller 2 can swing the flap 9 to the feeding position permitting the transport of the sheet P in the transport direction B. Therefore, as a result of the setting guide 5 swinging to the feeding position, the flap 9 can move in the transport direction B of the bottommost sheet P even when the edge of the sheet P being transported in the transporting direction B by the setting roller 2 collides with the flap 9, because the flap 9 is already permitted to swing to the feeding position. Therefore, the deformation of the sheet P immediately after the sheet feeding device 1-1 transitions from the standby state to the feeding state can be suppressed. As a result, the sheet feeding device 1-1 can realize the feeding state in which the flap 9 does not come into contact with the setting guide 5 before the bottommost sheet P, among the sheets P set in the shooter 14, comes into contact with the setting roller 2 as a result of the setting guide 5 swinging from the standby position towards the feeding position by the setting-guide swinging device 6. The flap 9 is permitted to swing to the feeding position by the locking mechanism 11, and the bottommost sheet P can be transmitted in the transport direction B. When the sheet feeding device 1-1 is in the feeding state, the sheet P being transported in the transport direction B swings the flap 9 to the feeding position. Therefore, damage to the sheet P by the flap 9 can be suppressed.

When the sheet feeding device 1-1 is in the feeding state, the separating roller 12 is already charged by the setting roller 2 rotating in the positive direction A. The rotary force in the separating direction I is generated in the rotating body 131 as a result of the force with which the reverse rotating spring 124 is charged. Therefore, even when, not only the bottommost sheet P, but multiple sheets P are transported in the transporting direction B, each sheet P comes into contact with the rotating body 121 of the separating roller 12. The separating roller 12 applies a transporting force in a direction opposite to the transporting direction B to the sheets P other than the bottommost sheet P. As a result, the sheets P other than the bottommost sheet P cannot pass through a space between the setting roller 2 and the separating roller 12. The sheets P are separated from the bottommost sheet P. In other words, when the sheet feeding device 1-1 is in the feeding state, only the bottommost sheet P in contact with the setting roller 2 can pass through the space between the setting roller 2 and the separating roller 12.

Described below is an operation performed when the sheet feeding device 1-1 transitions from the feeding state to the standby state. First, when the controlling device (not shown) judges, for example, the shooter 14 is out of sheets, the controlling device drives the motor 3 in the reverse direction. When the motor 3 generates the driving force in the reverse direction, as shown in FIG. 4, the setting roller 2 rotates the setting roller 2 in the negative direction J via the driving-force transmitting device 4. At this time, the separating roller 12 is contacting the setting roller 2. Therefore, the separating roller 12 rotates in the separating direction I and the force with which the reverse rotation spring 124 is charged is released. When the motor 3 generates the driving force in the reverse direction, the drive releasing device 63 connects the motor 3 and the swinging arm 61 and transmits the driving force generated by the motor 3 to the swinging arm 61. The drive releasing device 63 swings the swinging arm 61 in the other direction K against the biasing force from the setting guide spring 62. The setting guide 5 swings in the standby position direction L with the swinging of the swinging arm 61 in the other direction K.

At this time, because the sheets P are not set in the shooter 14, the flap 9 swings to the standby position using the biasing force from the flap spring 10. Therefore, the locking projection 111 of the flap 9 faces the locking recess 112 of the setting guide 5 swinging in the standby position direction L. The locking projection 111 enters the locking recess 112 when the setting guide 5 swings further in the standby position direction L. Therefore, the locking mechanism 11 prohibits the flap 9 from swinging in the feeding direction. When the setting guide 5 swings further in the standby position direction L, the setting guide 5 moves the pick arm 7 to a side opposite to the setting roller 2 side, or in other words, in the release direction M because the setting guide 5 and the pick arm 7 are integrated via the flap 9. As a result of the setting guide 5 swinging to the standby position, as shown in FIG. 1, the pick arm 7 is pressed upwards in the release direction M. The space between the pick arm 7 and the setting guide 5, namely the space between the pressing roller 73 and the contact surface 53 of the setting guide 5, widens. Therefore, the space between the setting guide 5 and the pick arm 7 can be widened while the sheet feeding device 1-1 is in the standby state, and the sheets P can be easily set in the shooter 14 through use of a single drive source.

As described above, according to the first embodiment, the standby state and the feeding state can be realized using a single drive source, i.e., the motor 3. After the prohibited movement of the sheet P in the transport direction B is permitted, the bottommost sheet P comes into contact with the setting roller 2. Therefore, the deformation of the sheet P can be suppressed that the setting roller 2 moves in the transport direction B immediately after transition from the standby state to the feeding state.

Figure 5:
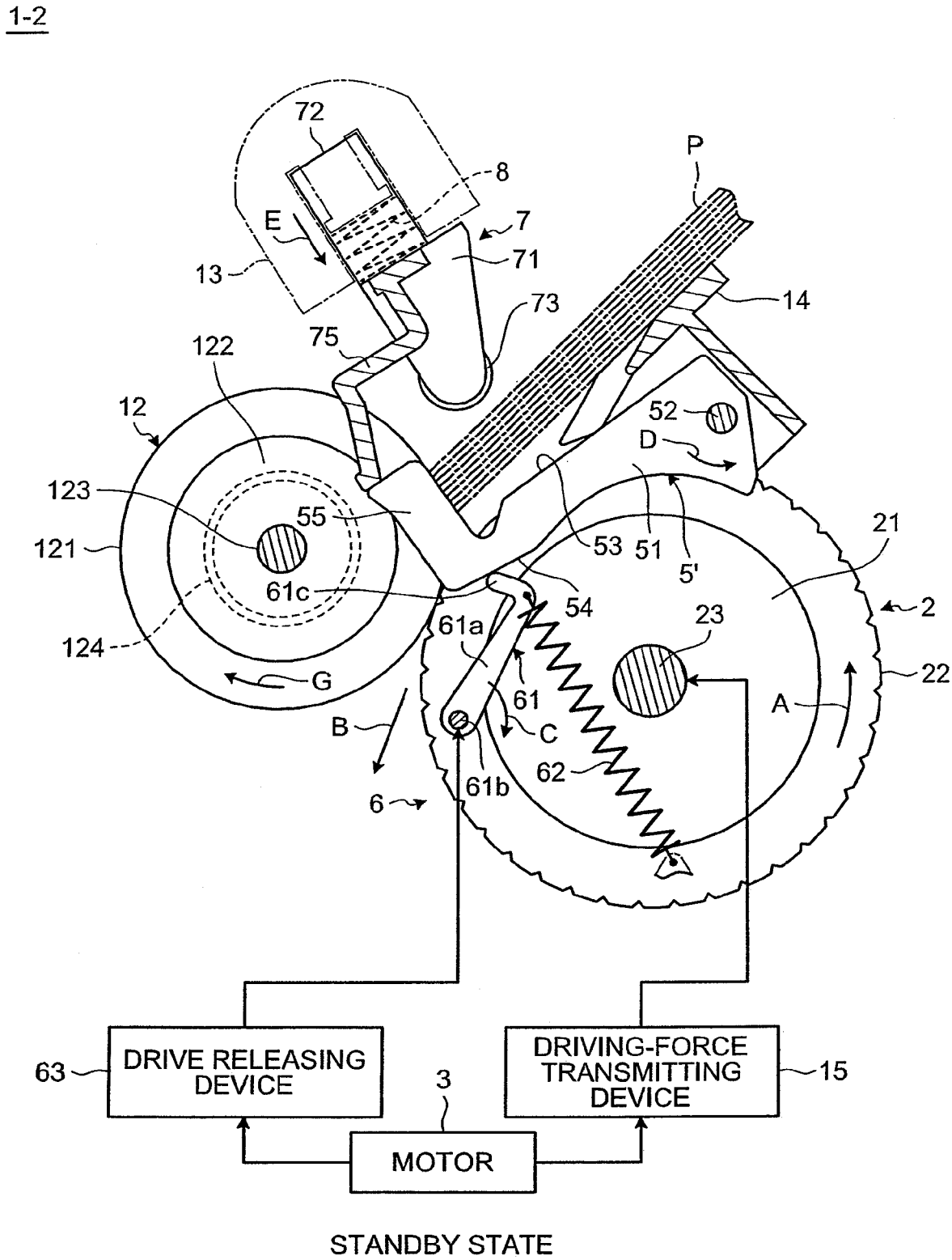
FIG. 5 is a schematic diagram of a sheet feeding device in a standby state according to a second embodiment of the present invention.
Figure 6:
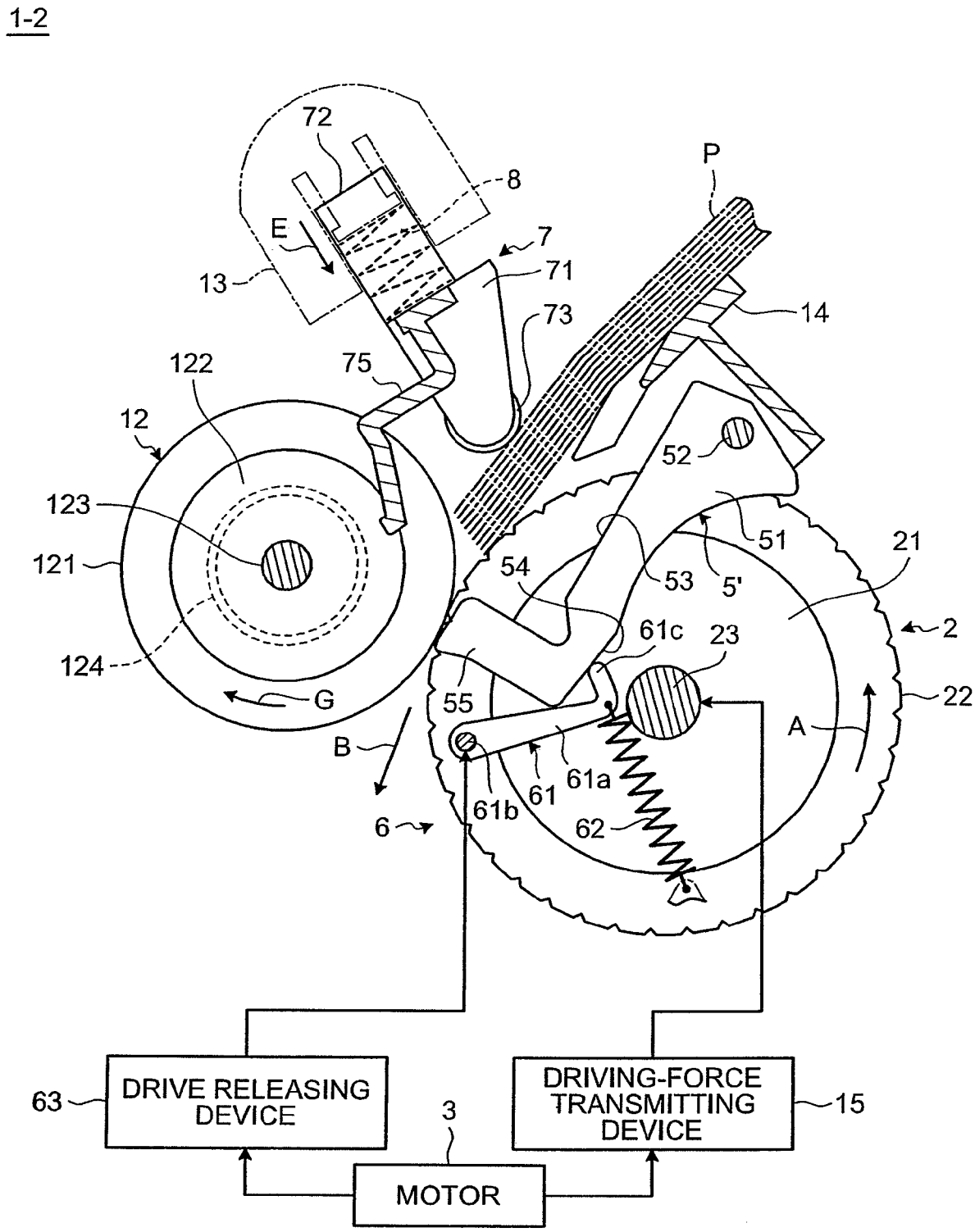
FIG. 6 is a schematic diagram for explaining the operation of the sheet feeding device shown in FIG. 5.
Figure 7:
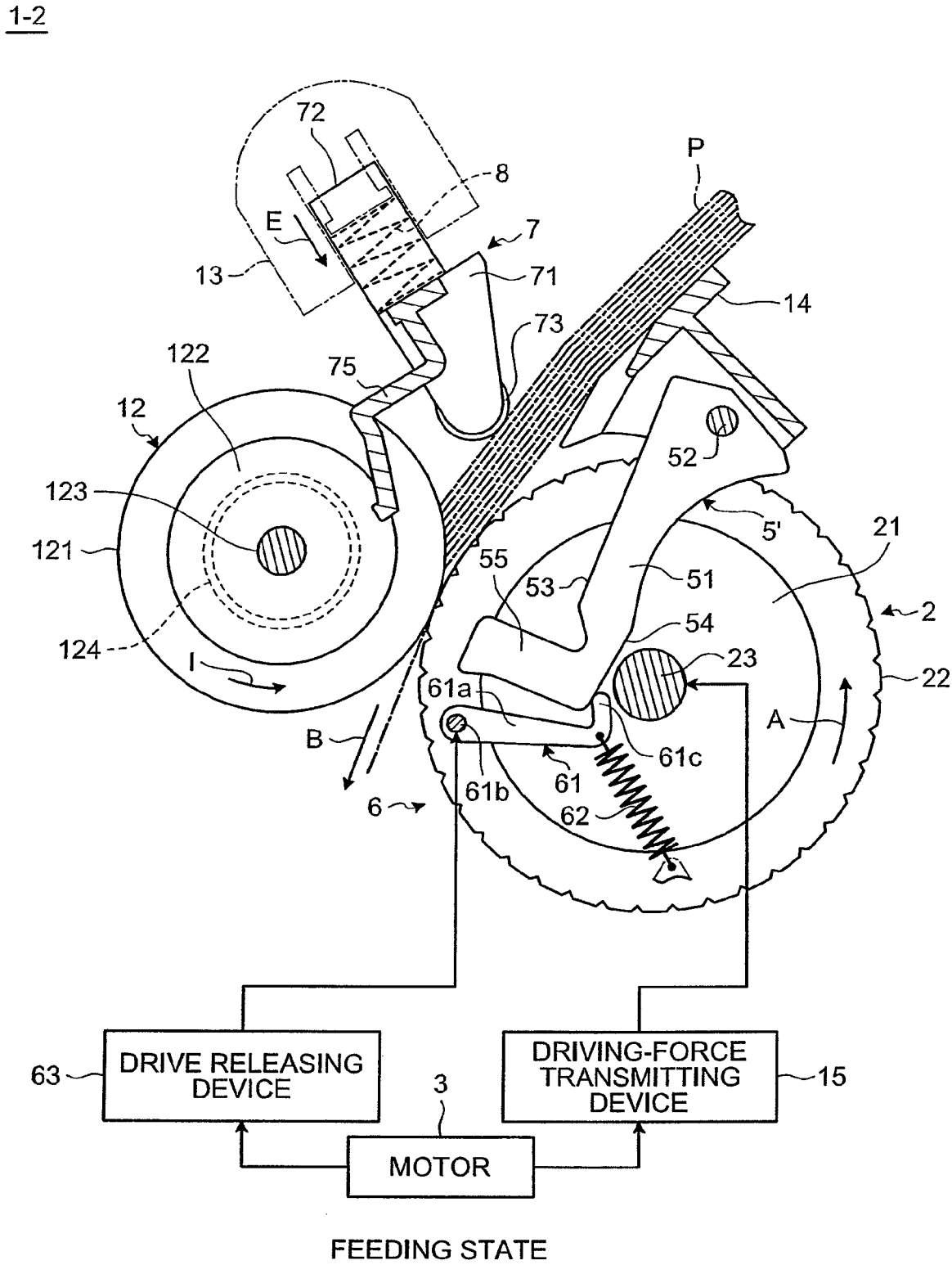
FIG. 7 is a schematic diagram of the sheet feeding device shown in FIG. 5 in a feeding state.
Figure 8:
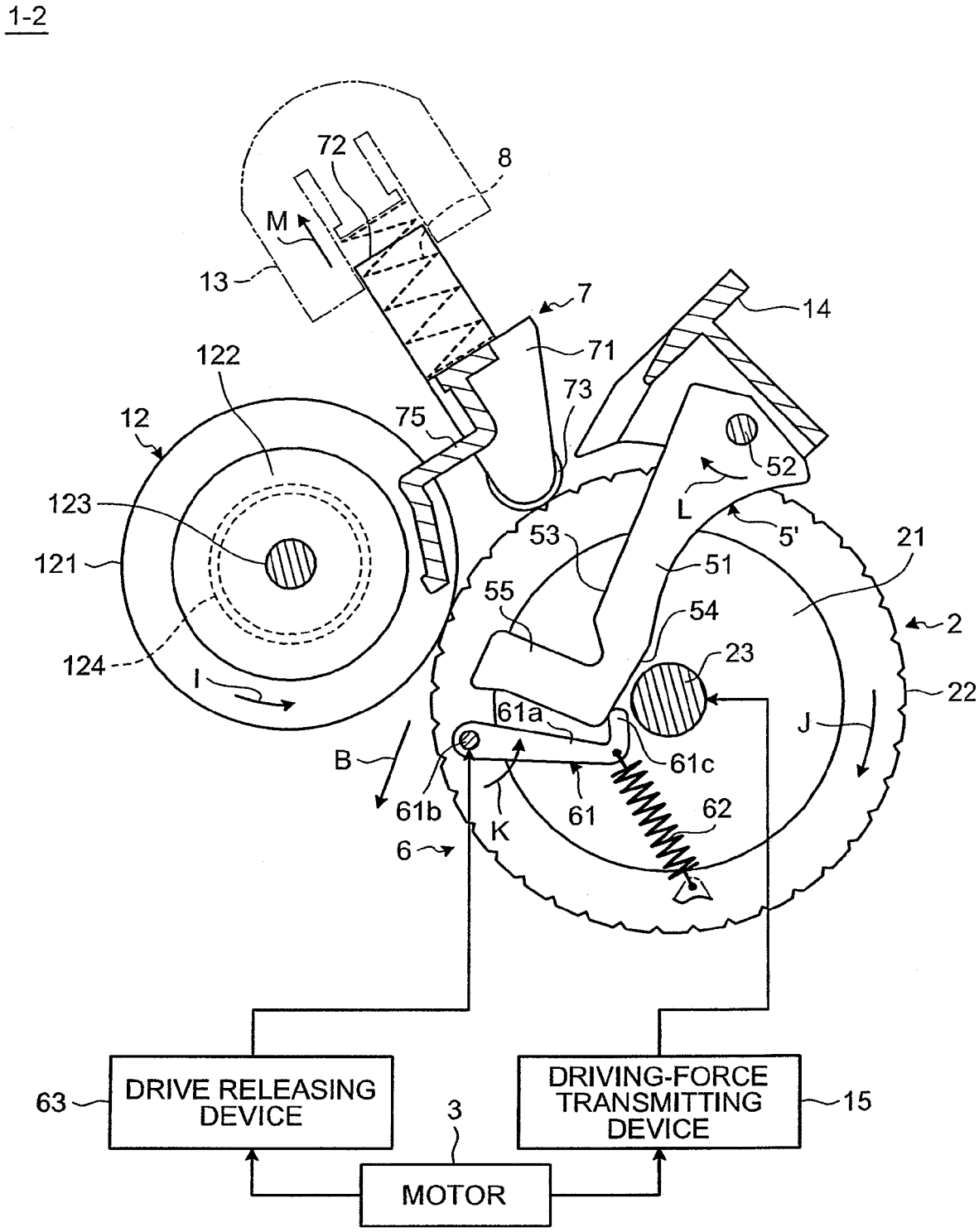
FIG. 8 is a schematic diagram for explaining the operation of the sheet feeding device shown in FIG. 5.

FIG. 5 is a schematic diagram of a sheet feeding device 1-2 (in a standby state) according to a second embodiment of the present invention. FIG. 6 is a schematic diagram for explaining the operation of the sheet feeding device 1-2. FIG. 7 is a schematic diagram of the sheet feeding device 1-2 in a feeding state. FIG. 8 is schematic diagram for explaining the operation of the sheet feeding device 1-2. The sheet feeding device 1-2 is of basically the same configuration and operates in a similar manner as the sheet feeding device 1-1 except that the flap 9 and the setting guide 5 are integrated, and therefore, the same explanation is not repeated. The sheet-feeding device 1-2 includes the setting roller 2, the motor 3, a flap-integrated setting guide 5', the setting-guide swinging device 6, the pick arm 7, the arm spring 8, the separating roller 12, and a driving-force transmitting device 15.

The flap-integrated setting guide 5' prohibits the movement of the sheets P in the transport direction B by coming into contact with the edges of the sheets P. The flap-integrated setting guide 5' also adjusts the contact state between the sheet P and the setting roller 2. The flap-integrated setting guide 5' includes the main body 51, the rotation axis 52, and a flap 55. The main body 51 includes the contact surface 53 and the back surface 54 opposing the contact surface 53. In the main body 51, the sheet P on the setting roller 2 side among the sheets P set in the shooter 14, namely the bottommost sheet P, is in contact with the contact surface 53. As a result, the main body 51 separates the bottommost sheet P and the setting roller 2. The rotating axis 52 is formed on one end of the main body 51. The rotating axis 52 is rotatably supported by the main body of the scanning device (not shown), i.e., the shooter 14. In other words, the flap-integrated setting guide 5' is rotatably supported with respect to the shooter 14. The setting-guide swinging device 6 swings the flap-integrated setting guide 5' between a standby position and a feeding position. In the standby position, the flap-integrated setting guide 5' separates the bottommost sheet P and the setting roller 2 by coming into contact with the bottommost sheet P. In the feeding position, the bottommost sheet and the setting roller 2 can come into contact.

The flap 55 prohibits the movement in the transport direction B of the sheets P set in the shooter 14 by coming into contact with the edges of the sheets P. The flap 55 is formed projecting from another end of the main body 51, in a direction from the back surface 54 towards the contact surface 53. In other words, the flap 55 and the main body 51 are integrated. When the setting-guide swinging device 6 positions the flap-integrated setting guide 5' in the standby position, the flap 55 is in a position in which the movement in the transport direction B of the sheets P set in the shooter 14 is prohibited by the flap 55 coming into contact with the edges of the sheets P. When the setting-guide swinging device 6 positions the flap-integrated setting guide 5' in the feeding position, the flap 55 is in a position in which the flap 55 does not come into contact with the sheet P being transported by the setting roller 2 in the transport direction B.

The pick arm 7 comes into contact with the sheets P by moving to the setting roller 2 side. When the setting roller 2 and the bottommost sheet P among the sheets P come into contact, the pick arm 7 presses the bottommost sheet P to the setting roller 2. As shown in FIG. 5, the pick arm 7 includes the main body 71, the spring storing section 72, the pressing roller 73, and a contact projection 75.

The contact projection 75 is integrated with the main body 71. The contact projection 75 projects from the main body 71 to the setting roller 2 side. The contact projection 75 comes into contact with the flap 55 when the flap-integrated setting guide 5' swings from the feeding position to the standby position. Therefore, as a result of the pick arm 7 swinging to the standby position of the flap-integrated setting guide 5', the pick arm 7 can move in the release direction M (see FIG. 8) via the contact projection 75.

The driving-force transmitting device 15 transits the driving force generated by the motor 3 to the setting roller 2. The driving-force transmitting device 15 includes, for example, the gear mechanism. As shown in FIG. 5, the driving-force transmitting device 15 rotates the setting roller 2 in the positive direction A when the motor 3 rotates in the forward direction. When the motor 3 rotates in the reverse direction, the driving-force transmitting device 15 rotates the setting roller 2 in the negative direction J (see FIG. 8) that is the direction opposite to the positive direction A. When the motor 3 drives in the forward direction and rotates the setting roller 2 in the positive direction A, the driving-force transmitting device 15 transmits the driving force generated by the motor 3 to the setting roller 2 after a timing at which the flap-integrated setting guide 5' starts swinging from the standby position to the feeding position. Specifically, the driving-force transmitting device 15 transmits the driving force generated by the motor 3 to the setting roller 2 after the flap 55 moves to a position in which the flap 55 does not come into contact with the edge of the bottommost sheet P of which the transport in the transporting direction B by the setting roller 2 has started as a result of the flap-integrated setting guide 5' starting to swing from the standby position to the feeding position.

Described below is an operation performed by the sheet feeding device 1-2. When the sheet feeding device 1-2 is in the standby state, as shown in FIG. 5, the setting-guide swinging device 6 positions the flap-integrated setting guide 5' at the standby position. When the flap-integrated setting guide 5' is positioned at the standby position, the pick arm 7 is pressed upwards in the release direction M (see FIG. 8) that is the direction opposite to the pressing direction E, via the contact projection 75 in contact with the flap 55. As a result, the space between the pick arm 7 and the flap-integrated setting guide 5', namely the space between the pressing roller 73 and the contact surface 53 of the flap-integrated setting guide 5', widens. When the sheet feeding device 1-2 is in the standby state, the user sets the sheets P in the shooter 14. The edges of the sheets P set in the shooter 14 come into contact with the flap 55. Here, when the sheet feeding device 1-2 is in the standby state, the setting-guide swinging device 6 prohibits the swinging of the flap-integrated setting guide 5' to the feeding position. Therefore, when the edges of the sheets P set in the shooter 14 are in contact with the flap 55, the movement of the sheets P in the setting direction is restricted. As a result, when the user sets the sheets P in the shooter 14, the positioning in the setting direction (substantially the same as the transport direction B) is facilitated. The bottommost sheet P, among the sheets P set in the shooter 14, comes into contact with the contact surface 53 of the flap-integrated setting guide 5'. In other words, when the sheet feeding device 1-2 is in the standby state, the setting roller 2 and the sheet P are separated. Therefore, even when the setting roller 2 rotates in the positive direction A when the sheet feeding device 1-2 is in the standby state, the bottommost sheet P is not transported in the transport direction B by the setting roller 2. As a result, the sheet feeding device 1-2 can realize the standby state in which the sheets P can be set in the shooter 14 holding the sheets P.

Described below is an operation performed when the sheet feeding device 1-2 transitions from the standby state to the feeding state. First, when the controlling device (not shown) judges, for example, that an instruction to read out the sheet P is given by the scanner (not shown), the controlling device drives the motor 3 in the forward direction. When the motor 3 generates the driving force in the forward direction, the drive releasing device 63 releases the connection between the motor 3 and the swinging arm 61. The drive releasing device 63 prevents the driving force generated by the motor 3 from being transmitted to the swinging arm 61. The swinging arm 61 swings in one direction C using the biasing force from the setting guide spring 62. The flap-integrated setting guide 5' swings in the feeding position direction D with the swinging of the swinging arm 61 in the one direction C. When the flap-integrated setting guide 5' swings in the feeding position direction D, as shown in FIG. 6, the pick arm 7 moves in the pressing direction E. The pick arm 7 presses the sheets P set in the shooter 14 in the pressing direction E. In other words, the pick arm 7 presses the sheets P towards the setting roller 2 side. When the flap-integrated setting guide 5' swings further in the feeding position direction D, the bottommost sheet P in contact with the flap-integrated setting guide 5' comes into contact with the setting roller 2, as a result of the pick arm 7 pressing the sheets P in the pressing direction E. The driving-force transmitting device 15 transmits the driving force generated by the motor 3 to the setting roller 2 when, as a result of the flap-integrated setting guide 5' swinging in the feeding position direction D when the bottommost sheet P comes into contact with the setting roller 2, the flap 55 moves to a position at which the flap 55 does not come into contact with the edge of the bottommost sheet P of which the transport in the transport direction B by the setting roller 2 has started. The setting roller 2 rotates in the plus A direction, via the driving force transmission device 15. At this time, the separating roller 12 is in contact with the setting roller 2. Therefore, the separating roller 12 rotates in the charging direction G and the reverse rotation spring 124 is charged with force.

At this time, the setting roller 2 rotates in the positive direction A using the driving force generated by the motor 3. Therefore, the transport of the bottommost sheet P, among the sheets set in the shooter 14, in the transport direction B is started. The bottommost sheet P of which the transport in the transport direction B by the setting roller 2 has started can be transported in the transport direction B without becoming deformed because the flap 55 of the flap-integrated setting guide 5' has already moved to a position at which the flap 55 does not come into contact with the edge of the bottommost sheet P of which the transport in the transport direction B has started. Therefore, the deformation of the sheet P immediately after the sheet feeding device 1-2 transitions from the standby state to the feeding state can be suppressed. As a result, as shown in FIG. 7, the sheet feeding device 1-2 can realize a feeding state in which the bottommost sheet P, among the sheets P set in the shooter 14, can be transported in the transport direction B because the flap 55 moves to a position at which the flap 55 does not come into contact with the bottommost sheet P being transported in the transporting direction B before the bottommost sheet comes into contact with the setting roller 2, as a result of the setting-guide swinging device 6 swinging the flap-integrated setting guide 5' from the standby position towards the feeding position.

When the flap-integrated setting guide 5' swings further in the standby position direction L, the contact projection 75 of the pick arm 7 comes into contact with the flap 55 of the flap-integrated setting guide 5'. When the flap-integrated setting guide 5' swings further in the standby position direction L, the flap-integrated setting guide 5' moves the pick arm 7 to the side opposite to the setting roller 2 side, namely the release direction M side, because the flap-integrated setting guide 5' and the pick arm 7 are integrated via the contact projection 75. As a result of the flap-integrated setting guide 5' swinging to the standby position, as shown in FIG. 5, the pick arm 7 is pushed upwards in the release direction M. The space between the pick arm 7 and the flap-integrated setting guide 5', namely the space between the pressing roller 73 and the contact surface 53 of the flap-integrated setting guide 5', widens. Therefore, the space between the flap-integrated setting guide 5' and the pick arm 7 can be widened when the sheet feeding device 1-2 is in the standby state, and the sheets P can be easily set in the shooter 14 1-2 through use of the single drive source.

As described above, according to the second embodiment, the standby state and the feeding state can be realized using a single drive source, i.e., the motor 3. The flap 55 is moved to the position at which the flap 55 does not come into contact with the edge of the bottommost sheet P, of which the transport in the transport direction B has started as a result of the bottommost sheet P and the setting roller 2 coming into contact, before the edge of the bottommost sheet P being transported in the transport direction B and the flap 55 come into contact. Therefore, the deformation of the sheet P moving in the transport direction B by the setting roller 2 immediately after the sheet feeding device 1-2 transitions from the standby state to the feeding state can be suppressed.

According to the second embodiment, a timing at which the driving force generated by the motor 3 is transmitted to the setting roller 2 is delayed to suppress the deformation of the sheet P moved in the transport direction B by the setting roller 2 immediately after transition from the standby state to the feeding state. However, the invention is not limited thereto. For example, a speed at which the flap-integrated setting guide 5' swings from the standby position to the feeding position by the setting-guide swinging device 6 can be set such that the flap 55 can move to the position at which the flap 55 does not come into contact with the edge of the bottommost sheet P of which transport has started before the edge of the bottommost sheet P and the flap 55 come into contact. The swinging speed is changed by, for example, changing a spring constant of the setting guide spring 62.

The separating roller 12 is preferably charged before the sheet feeding device 1-1 and the sheet feeding device 1-2 enter the standby state, or in other words, before the sheets P are set in the shooter 14. Specifically, the controlling device (not shown) drives the motor 3 in the forward direction, the rotation body 121 of the separation roller 12 rotates in the charging direction G, and the reverse rotation spring 124 is charged with force preferably before the sheet feeding device 1-1 and the sheet feeding device 1-2 enter the standby state.

When the cover 13 of the scanner (not shown) is opened, the drive releasing device 63 preferably releases the connection between the motor 3 and the swinging arm 61 and prevents the driving force generated by the motor 3 from being transmitted to the swinging arm 61. In other words, when the cover 13 of the scanner (not shown) is opened, the setting guide 5 or the flap-integrated setting guide 5' preferably waits at the standby position as a result of the swinging arm 61 swinging in the one direction C using the biasing force from the setting guide spring 62. As a result, when the cover 13 is closed, the damage to the sheets P set in the shooter 14 as a result of coming into contact with the setting guide 5 can be suppressed.

As set forth hereinabove, according to an embodiment of the present invention, the standby state and the feeding state can be realized by using a single drive source. Besides, it is possible to suppress deformation of a print medium that is transported by a pick roller immediately after a sheet feeding device transitions from the standby state to the feeding state.

Moreover, a space between a setting guide and a pick arm can be widened in standby state. Thus, print media can be easily set and positioned in the sheet feeding device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a roller configured to be brought in contact with a print medium and rotate to apply a transport force to the print medium in order to transport the print medium in a transport direction;

a driving unit configured to generate a driving force to rotate the roller;

a flap configured to swing between a first standby position and a first feeding position, the flap coming into contact with an edge of the print medium at the first standby position not to allow transport of the print medium and allowing the transport at the first feeding position;

a guide configured to swing between a second standby position and a second feeding position, the guide coming into contact with the print medium at the second standby position to separate the print medium from the roller and allowing the print medium to be in contact with the roller at the second feeding position;

a guide-swinging member configured to swing the guide using the driving force generated by the driving unit; and a locking member configured to bring the flap at the first standby position into contact with the guide at the second standby position to prevent the flap from swinging to the first feeding; wherein the guide-swinging member includes:

a swinging mechanism configured to drive the driving unit in a second direction opposite to a first direction, in which the driving unit is driven to transport the print medium, to move the guide from the second feeding position to the second standby position;

a guide biasing unit that biases the guide in a direction in which the guide swings to the feeding position; and a releasing unit configured to release a connection between the driving unit and the swinging mechanism at least when the driving unit is driven in the first direction.

2. The sheet feeding device according to claim 1, wherein the flap moves in the transport direction when swinging from the first standby position to the first feeding position; and the locking member allows the flap to swing to the first feeding position before the print medium comes into contact with the roller when the guide swings from the second standby position to the second feeding position.

3. The sheet feeding device according to claim 2, further comprising a flap-biasing member that applies a biasing force to the flap so that the flap swings to the first standby position, wherein the biasing force is less than the transport force.

4. The sheet feeding device according to claim 3, further comprising:

an arm that moves to come into contact with the print medium in contact with the roller and presses the print medium against the roller; and an arm-biasing member that biases the arm towards the roller, wherein the guide moves the arm to a side opposite to the roller through the flap while the guide-swinging member swings the guide from the second feeding position to the second standby position.

5. The sheet feeding device according to claim 1, wherein the locking member includes a projection formed on an end of the flap; and a recess formed on a surface of the guide facing the flap, the projection engages in the recess when the flap is at the first standby position and the guide is at the second standby position, and the projection disengages from the recess when the guide moves from the second standby position to the second feeding position.

* * * * *